US009196940B2

(12) United States Patent
Brown et al.

(10) Patent No.: US 9,196,940 B2
(45) Date of Patent: Nov. 24, 2015

(54) WAVEGUIDE MECHANICAL PHASE ADJUSTER

(71) Applicant: Raytheon Company, Waltham, MA (US)

(72) Inventors: Kenneth W. Brown, Yucaipa, CA (US); Darin M. Gritters, Yucaipa, CA (US); Andrew W. Chang, Claremont, CA (US)

(73) Assignee: Raytheon Company, Waltham, MA (US)

( * ) Notice: Subject to any disclaimer, the term of this patent is extended or adjusted under 35 U.S.C. 154(b) by 88 days.

(21) Appl. No.: 14/201,410

(22) Filed: Mar. 7, 2014

(65) Prior Publication Data

US 2015/0255843 A1 Sep. 10, 2015

(51) Int. Cl.
*H01P 3/12* (2006.01)
*H01P 1/18* (2006.01)

(52) U.S. Cl.
CPC ..... *H01P 1/182* (2013.01)

(58) Field of Classification Search
USPC ..... 333/157–159, 239–240, 242; 385/39, 385/50
See application file for complete search history.

(56) References Cited

U.S. PATENT DOCUMENTS 2,994,874 A * 8/1961 Kihn et al. ..... 343/768
4,994,679 A * 2/1991 Esser et al. ..... 250/559.3
2005/0270120 A1* 12/2005 Guo ..... 333/134

* cited by examiner

*Primary Examiner* — An Luu
(74) *Attorney, Agent, or Firm* — Eric A. Gifford

(57) ABSTRACT

A waveguide mechanical phase adjuster includes at least one pair of dielectric rods nominally spaced ¼ wavelength apart and inserted through a corresponding pair of holes in the wall of a waveguide. The holes are dimensioned so that they are in "cutoff" at the top end of the spectral band. An adjustment mechanism sets the insertion depth of the rods, which determines the amount of dielectric loading and, in turn, the insertion phase. Changing the insertion depth changes the dielectric loading, hence the insertion phase. The ¼ wavelength spacing of the rods serves to cancel reflected energy. Additional pairs of dielectric rods can be similarly configured and actuated to increase the range over which the insertion phase can be adjusted. The waveguide mechanical phase adjuster is well adapted for use with power combiners to maintain tight phase coherence between channels.

20 Claims, 8 Drawing Sheets

WAVEGUIDE MECHANICAL PHASE ADJUSTER

GOVERNMENT LICENSE RIGHTS

The U.S. Government has a paid-up license in this invention and the right in limited circumstances to require the patent owner to license others on reasonable terms as provided for by the terms of contract number HR0011-12-C-0091 and HR0011-13-C-0015 awarded by the Department of Defense.

BACKGROUND OF THE INVENTION

1. Field of the Invention

This invention relates to waveguide phase shifting, and more particularly to techniques to achieve phase coherency between channels in a power combiner.

2. Description of the Related Art

Power combiners include an RF waveguide splitter that separates RF power provided at an RF input into multiple waveguide channels, solid-state amplifier chips that amplify the RF signal in each channel and an RF combiner that combines the amplified RF signals into a single amplified RF signal. The combiner may be either a waveguide combiner or a spatial combiner that utilizes free-space radiating elements. In this context, a "waveguide" is a hollow metal rectangular waveguide dimensioned for propagation of energy in a particular spectral band within the RF spectrum extending from approximately 300 MHz to approximately 1.1 THz.

To optimize combination efficiency and achieve the maximum combined power, tight phase coherency must be maintained between the channels. Each amplifier chip has a characteristic insertion phase. This phase will vary to some extent from chip-to-chip. At the higher RF frequencies in the MMW and THz regimes, fabrication tolerances in the waveguide splitter and combiner will produce phase errors that vary from channel-to-channel.

One approach to achieving phase coherency is to measure the phase of a number of amplifier chips and select chips having a similar phase within a specified tolerance. This approach is feasible if you have a sufficiently large pool of amplifier chips from which to select and if the phase errors in the waveguide splitter and combiner are negligible.

Another approach is to pair each amplifier chip with a phase-shifter chip, which can be tuned via a control signal to adjust channel phase. This approach is feasible, for example, in the X and KA bands toward the lower frequency end of the RF spectrum. At higher frequencies in the MMW and THz regimes, the phase-shifter chips become very lossy.

Another approach is to insert a wedge of dielectric material into each channel to essentially "shim" the phase. Calibration of multi-channel power combiners using this approach can be very tedious, practically impossible for more than 2 channels. The waveguides have to be disassembled, the wedge inserted and the waveguide reassembled. The phase of each channel can be measured independently to get an initial solution with different wedges being inserted until each channel has the same nominal phase. However, there is some degree of cross-coupling between the channels. Consequently, to achieve optimal performance one must calibrate for maximum power with all channels. The adjustments to achieve maximum power can be highly iterative and difficult to achieve optimal performance.

SUMMARY OF THE INVENTION

The following is a summary of the invention in order to provide a basic understanding of some aspects of the invention. This summary is not intended to identify key or critical elements of the invention or to delineate the scope of the invention. Its sole purpose is to present some concepts of the invention in a simplified form as a prelude to the more detailed description and the defining claims that are presented later.

The present invention provides a mechanical phase adjuster for tuning the phase of a waveguide in a band in the RF spectrum, and particularly at higher frequency bands in the MMW and THz regimes of the RF spectrum. The mechanical phase adjuster enables tight phase coherency between channels in a power combiner.

This is accomplished by configuring a wall of the waveguide with a pair of holes that are nominally spaced one-quarter of the center wavelength of the spectral band apart. The holes are dimensioned so that they are in "cutoff" at the top end of the spectral band. A pair of dielectric rods is inserted through the pair of holes into the waveguide. An adjustment mechanism sets the insertion depth of the rods, which determines the amount of dielectric loading and, in turn, the insertion phase. Changing the insertion depth changes the dielectric loading, hence the insertion phase. The pair of rods nominally spaced ¼ wavelength apart serves to cancel reflected energy. Additional pairs of dielectric rods can be similarly configured and actuated to increase the range over which the insertion phase can be adjusted. The pairs of dielectric rods are suitably positioned an odd integer multiple of the ¼ wavelength apart, and preferably just ¼ wavelength apart to maintain bandwidth.

In an embodiment of a power combiner, multiple mechanical phase adjusters are used to calibrate the insertion phase of each channel to maintain tight phase coherency between channels to maximize output power. The power combiner may be configured to use either waveguide or spatial combining of the amplified channels. An RF input configured to receive energy in a spectral band. The RF input is coupled to a 1:N hollow metal rectangular waveguide splitter that separates the RF energy equally between N waveguide channels. Each channel feeds a solid-state amplifier chip that amplifies the RF energy. Mechanical phase adjusters are configured in at least N-1 of the channels in front of the amplifier chips to adjust the insertion phase. The amplified and coherent RF energy is combined and output. For waveguide combining, the N amplified channels are coupled to a N:1 hollow metal rectangular waveguide combiner that combines the amplified RF energy in the N waveguide channels into a single waveguide channel that is coupled to an RF output. For spatial combining, the amplified channels are coupled via M×N free-space radiating elements. Each channel may feed a single radiating element, a 1D array of radiating elements or a 2D aperture of radiating elements.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a mechanical phase adjuster for tuning the phase of a waveguide in a band in the RF spectrum, and particularly at higher frequency bands in the MMW and THz regimes of the RF spectrum. The mechanical phase adjuster enables tight phase coherency between channels in a power combiner. As used herein the term "waveguide" refers to a hollow metal structure dimensioned for propagation of energy in a spectral band at frequencies between approximately 300 MHz to 1.1 THz. The waveguide is typically rectangular but may be square or circular.

Figure 1:
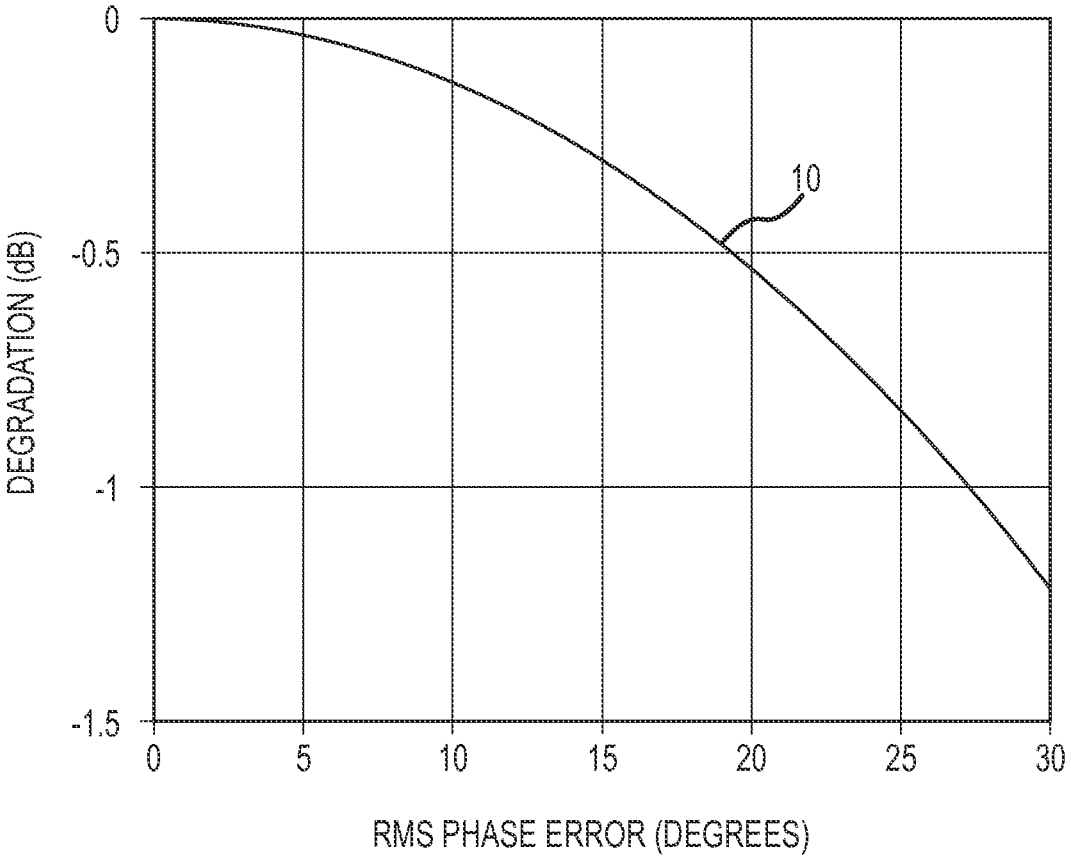
FIG. 1 is a plot of the degradation of the combined power for a 4-way power combiner versus RMS phase error between the channels.

FIG. 1 is a plot 10 of the degradation in dB of the combined power of a 4-way combiner versus RMS (root-mean-square) phase error between the channels. The combined power degrades as the phase error increases. It is desirable to maintain tight phase coherency between the channels to avoid such degradation.

Figure 2A:
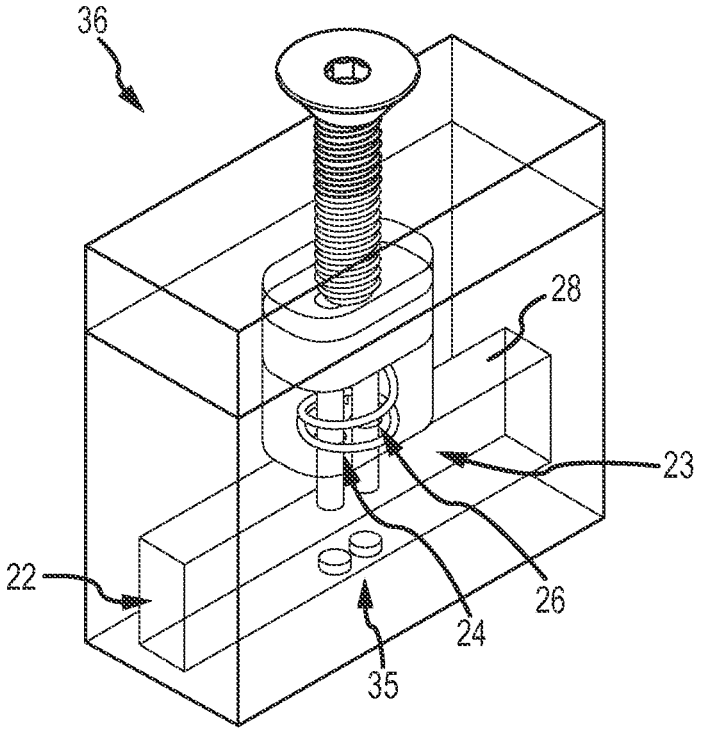
FIGS. 2*a*, 2*b* and 2*c* are perspective, side and end views of an embodiment of a waveguide mechanical phase adjuster.
Figure 2B:
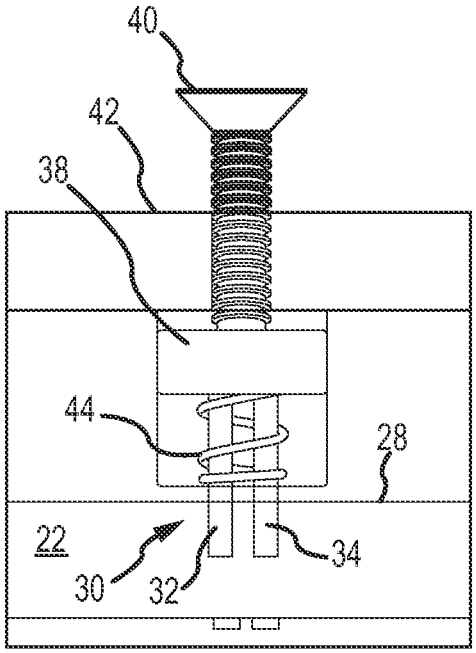
Figure 2C:
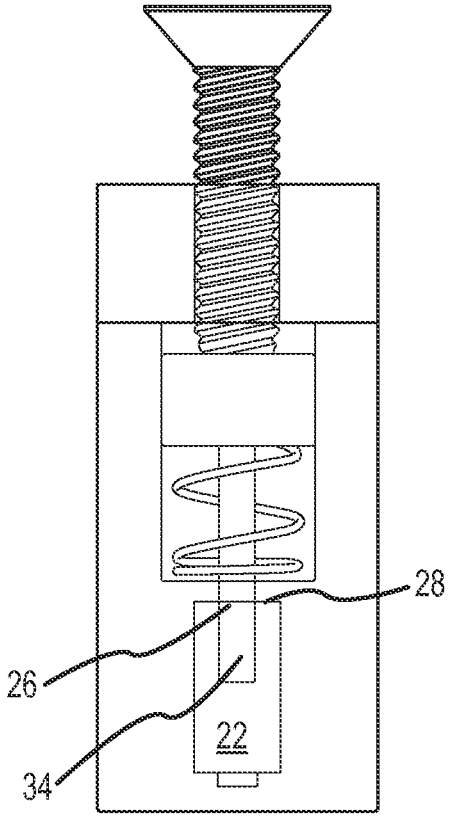

As shown in FIGS. 2*a*, 2*b* and 2*c*, an embodiment of a waveguide mechanical phase adjuster (MPA) 20 comprises a waveguide 22. A pair 23 of holes 24 and 26 is formed in a wall 28 of the waveguide 22. Holes 24 and 26 are nominally spaced one-quarter of the center wavelength of the spectral band apart. A pair 30 of dielectric rods 32 and 34 is inserted through the pair 23 of holes 24 and 26 into the waveguide 22. A second pair 35 of holes may be formed in the opposing wall to facilitate complete insertion of the dielectric rods into the waveguide to achieve maximum phase shift. The holes, as filled with the dielectric rod, are dimensioned so that they are in "cutoff" at the top end of the spectral band, hence the entire spectral band. This ensures no energy leakage through the holes. Spacing the rods nominally ¼ wavelength apart in pairs serves to cancel reflected energy. For optimal cancellation, the rods preferably have a circular cross-section. However, other shapes e.g. a diamond cross-section, may be used.

An adjustment mechanism 36 sets the insertion depth of the pair of rods, which determines the amount of dielectric loading and, in turn, the insertion phase. Changing the insertion depth changes the dielectric loading, hence the insertion phase. To maximize the insertion depth, hence the possible phase change; the rods are suitably inserted through the narrower wall of the rectangular waveguide.

In this embodiment, adjustment mechanism 36 is a spring-loaded screw adjustment mechanism. The pair of dielectric rods is attached to a plate 38. A screw 40 is threaded through another plate 42 to push down on plate 38 to set the insertion depth. A spring 44 positioned between plate 38 and the top of waveguide 22 provides a counter force that prevents plate 38 and the dielectric rods from falling into the waveguide. Other implementations of the adjustment mechanism exist.

Figure 3:
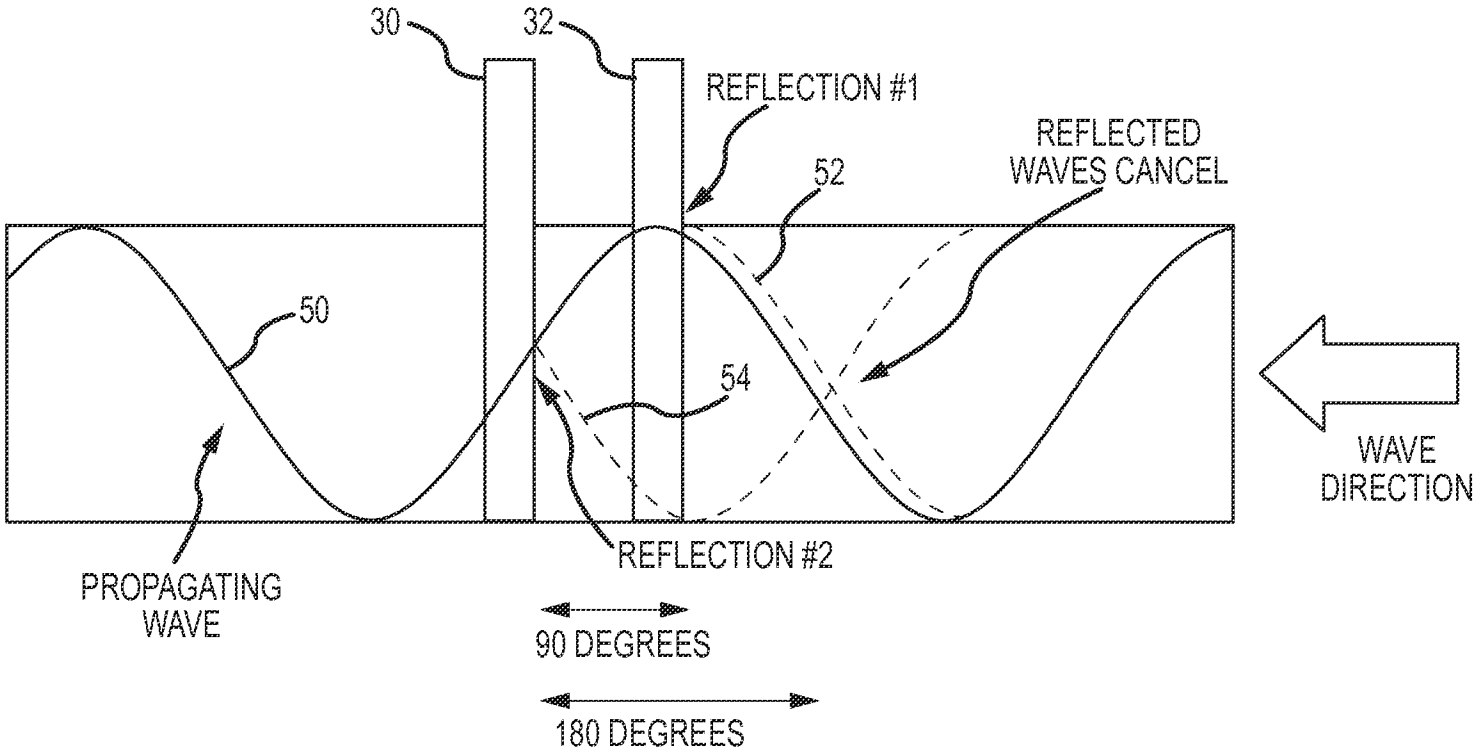
FIG. 3 is a diagram illustrating constructive interference of the reflections off of the pair of dielectric rods to minimize reflected power.

FIG. 3 is a diagram illustrating constructive interference of the reflections off of the pair of dielectric rods 32 and 34 to minimize reflected power. The rods work in pairs to "tune out" the reflection from each rod. An incoming wave 50 hits the first rod 32, and a small portion 52 of the energy is reflected back to the source, the bulk of the energy traveling through the first rod 32. The bulk remaining energy hits the second rod 34 and a small portion 54 of the energy is reflected back to the source. Because the rods are nominally spaced by 90 degrees, the reflected energy 54 from the second rod 34 is 180 degrees out of phase from the reflected energy 52 from the first rod 32. When signals that are 180 degrees out of phase with each other collide, they completely cancel.

The rods 32 and 34 in a pair are ideally identical; identical in material composition, diameter and insertion depth into the waveguide to produce signals that are 180 degrees out of phase. In practice, the rods are designed to be identical and implemented to be as close to identical as possible within a given design tolerance.

The rods 32 and 34 are nominally ¼ wavelength apart. The exact spacing depends on the rod material and diameter and the spectral band. The spacing isn't a perfect 90 degrees of waveguide length because there is now dielectric in the waveguide, which slows down the wave. The rod also does not provide the full and perfect reflection at the forward tip of the circumference.

In an embodiment, the dielectric material for the rods is selected. Low loss material is preferred to maximize the transmitted power through the waveguide. Materials such as Teflon, Quartz, and Fiber Optic Stock that have dielectric constants (DK) in the 2-7 range balance the desire for low loss with the requirement for an appreciable phase shift. Once the material is chosen, the hole diameter is calculated so that it is in cut-off when filled with the dielectric material. Given the dielectric material and the diameter of the material, the MPA and waveguide can be simulated to find the optimal spacing to minimize reflected power.

Figure 4:
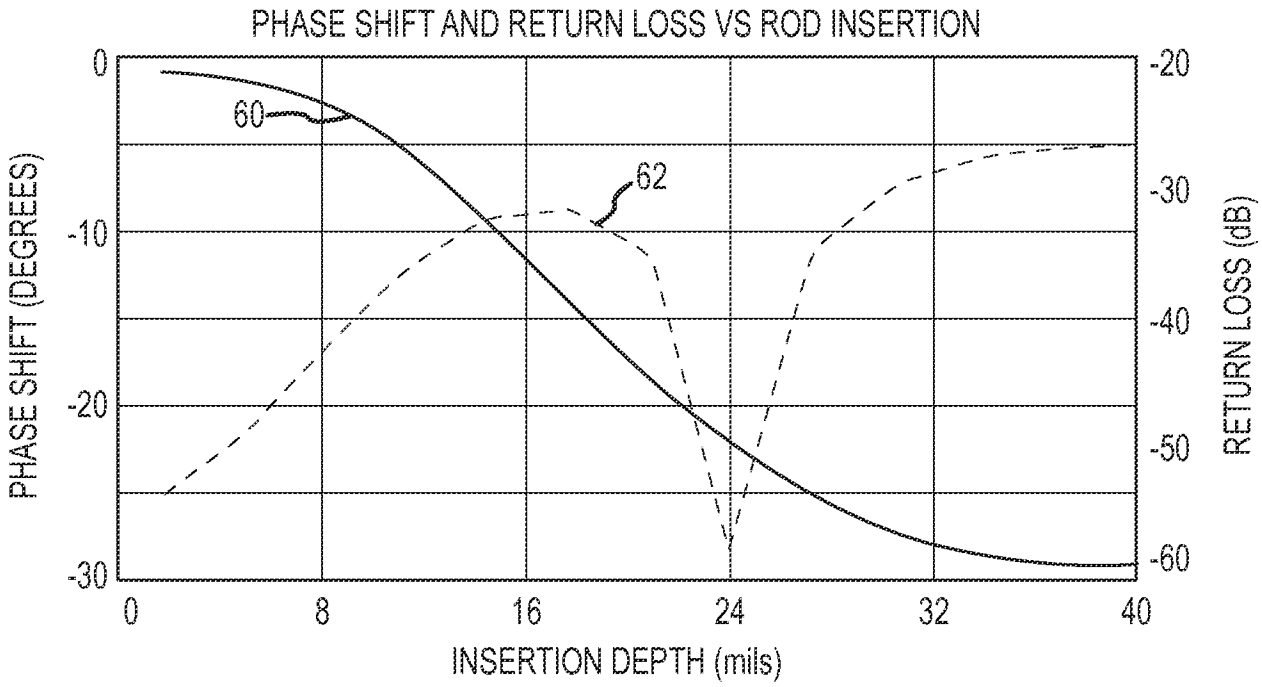
FIG. 4 is a plot of phase shift and return loss versus insertion depth of the pair of dielectric rods.

FIG. 4 is a plot of phase shift 60 and return loss 62 versus insertion depth of the pair of dielectric rods. As the pair of rods is inserted further into the waveguide the amount of dielectric loading, hence phase shift 60 increases. Phase shift comes from the wave energy traveling through the dielectric material. The more material in the path the larger the induced phase shift. In this example, the phase shift can range from 0 to about 30 degrees from zero to maximum insertion depth. Throughout the insertion depth range, the return loss 62 of the reflected power is greater than −25 db. The drastic reduction in return loss 62 occurs when the insertion depth coincides in length with a specific frequency in the band of interest, and a perfect cancelation of the reflected signals is achieved. The pair of dielectric rods is effective at inducing a significant phase shift and cancelling reflected power.

Figure 5:
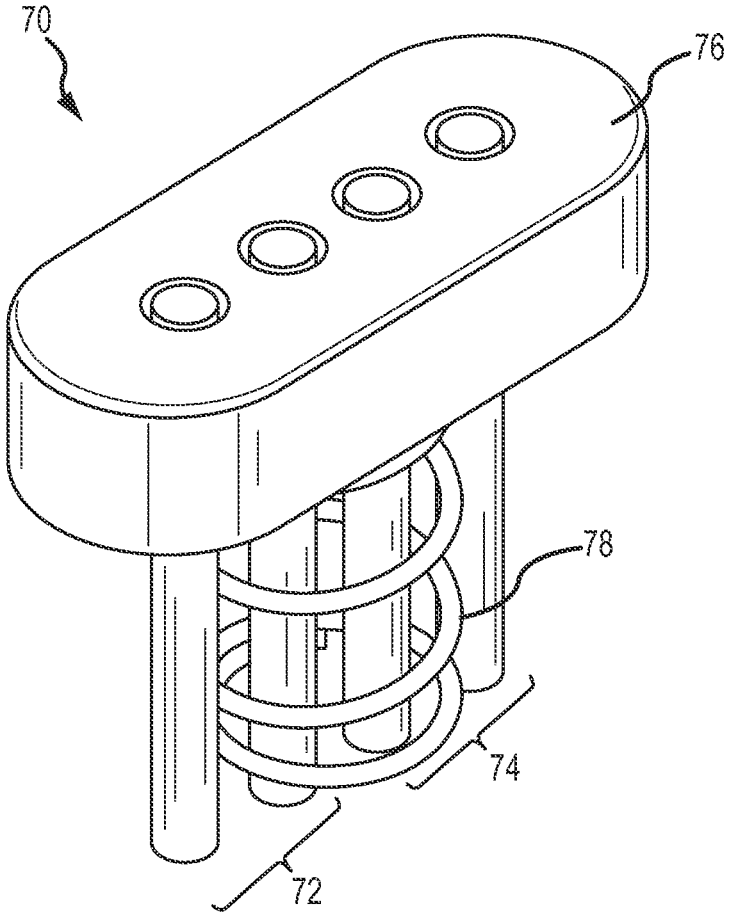
FIG. 5 is a diagram of another embodiment of a waveguide mechanical phase adjuster including two pairs of dielectric rods.

As shown in FIG. 5, an alternate embodiment of a dielectric rod assembly 70 for use in a waveguide MPA includes two pair of dielectric rods 72 and 74. Given the same insertion depth, this configuration doubles the range of induced phase shift. Each pair of rods is configured as previously described with the rods separated by nominally ¼ wavelength. The pairs are suitably positioned an odd integer multiple of the ¼ wavelength apart to minimize total reflected power. Simulations have shown that spacing the pairs a single ¼ wavelength apart preserves bandwidth. As depicted in this embodiment, both pairs of dielectric rods 72 and 74 are terminated in a common plate 76, which in turn is adjusted by a single screw resisted by a common spring 78. Alternately, each pair of rods could be adjusted independently.

A use for the waveguide MPA is to maintain tight phase coherency between channels in a power combiner to maximize the combined output power. The power combiner may be configured to use either waveguide or spatial combining of the amplified channels. An RF input configured to receive energy in a spectral band. The RF input is coupled to a 1:N hollow metal rectangular waveguide splitter that separates the RF energy equally between N waveguide channels. Each channel feeds a solid-state amplifier chip that amplifies the RF energy. Mechanical phase adjusters are configured in at least N-1 of the channels in front of the amplifier chips to adjust the insertion phase. The amplified and coherent RF energy is combined and output. For waveguide combining, the N amplified channels are coupled to a N:1 hollow metal rectangular waveguide combiner that combines the amplified RF energy in the N waveguide channels into a single waveguide channel that is coupled to an RF output. For spatial combining, the amplified channels are coupled via M×N free-space radiating elements. Each channel may feed a single radiating element, a 1D array of radiating elements or a 2D aperture of radiating elements. The waveguide MPAs are easily and accurately adjustable to set the phase of each channel.

Figure 6:
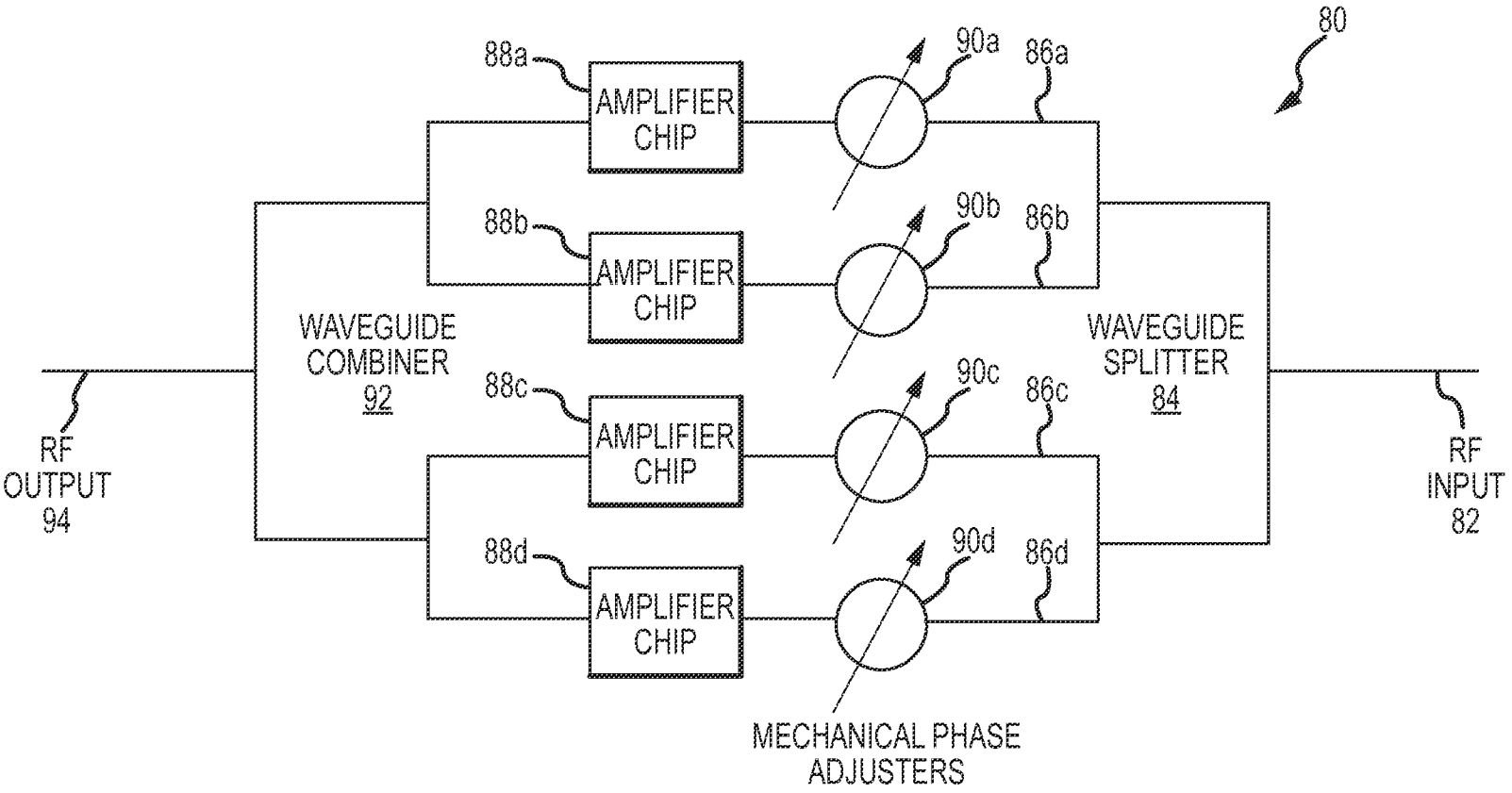
FIG. 6 is a block diagram of a 2-channel waveguide power combine provided with mechanical phase adjusters.

As shown in FIG. 6, an embodiment of a waveguide power combiner 80 comprises an RF input 82 that is coupled to a 12 waveguide splitter 84 that separates the RF energy equally between 4 waveguide channels 86*a*, 86*b*, 86*c* and 86*d* of nominally the same phase that feed solid-state amplifier chips 88*a*, 88*b*, 88*c* and 88*d* that amplify the RF energy. Mechanical phase adjusters 90*a*, 90*b*, 90*c* and 90*d* are positioned in each channel upstream of the amplifier chips to precisely adjust the insertion phase. A 4:1 waveguide combiner 92 combines the amplified RF energy at an RF output 94.

Figure 7:
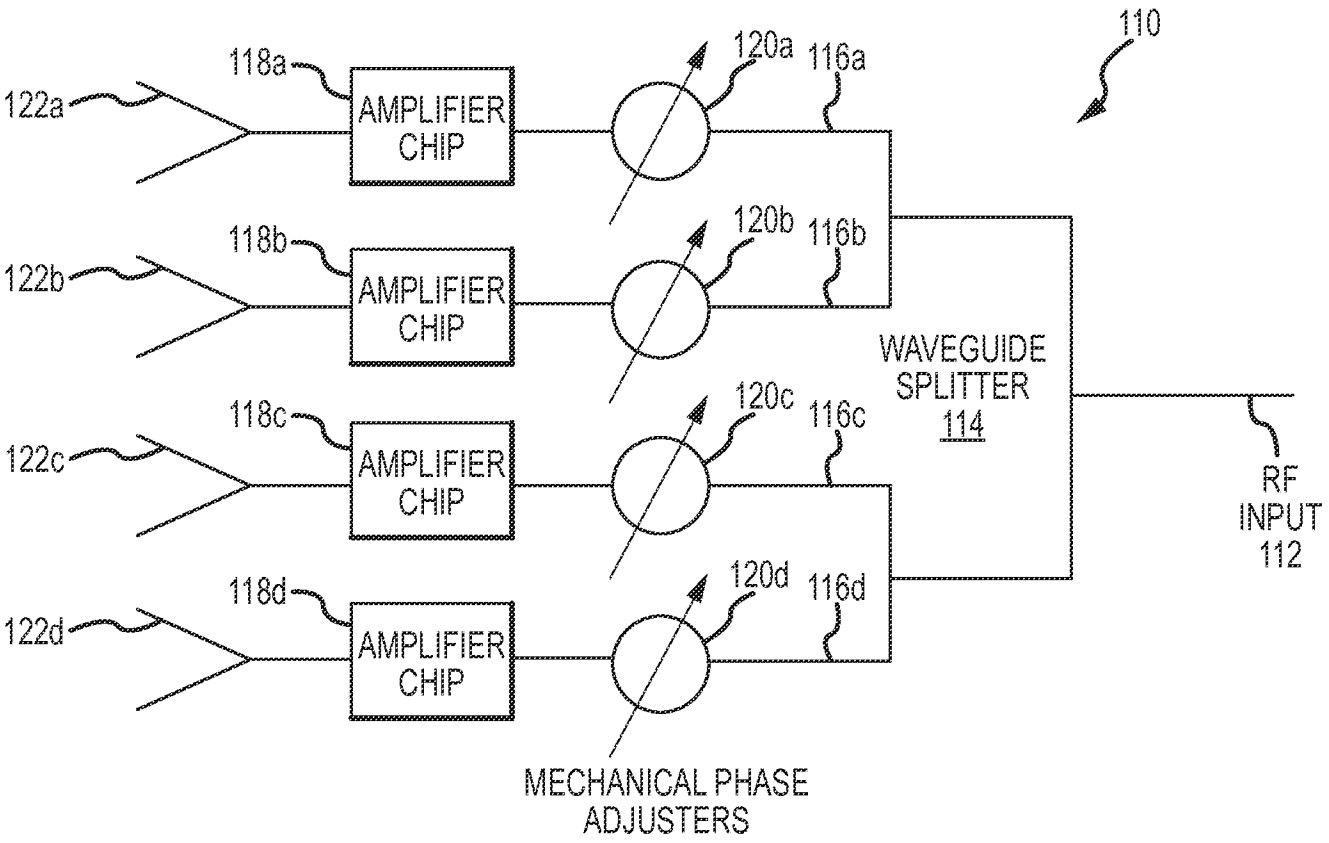
FIG. 7 is a block diagram of a 4-channel spatial power combiner provided with mechanical phase adjusters.

As shown in FIG. 7, an embodiment of a spatial power combiner 110 comprises an RF input 112 that is coupled to a 1:4 waveguide splitter 114 that separates the RF energy equally between 4 waveguide channels 116*a*-116*d* of nominally the same phase that feed solid-state amplifier chips 118*a*-118*d* that amplify the RF energy. Mechanical phase adjusters 120*a*-120*d* are positioned in each channel upstream of the amplifier chips to precisely adjust the insertion phase. Four free-space radiating elements 122*a*-122*d* radiate the amplified energy into free-space where it is spatially combined.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A waveguide mechanical phase adjuster, comprising:

a hollow metal waveguide dimensioned for propagation of energy in a spectral band;

a first pair of holes in a wall of the waveguide, said holes spaced approximately one-quarter of a center wavelength of the band apart, said holes dimensioned such that the holes are in cutoff at the highest frequency in the spectral band;

a first pair of dielectric rods inserted through said first pair of holes in the wall of the waveguide; and a first adjustment mechanism for varying an insertion depth of the first pair of rods into the waveguide to vary a dielectric loading of the waveguide and set an insertion phase of the propagating energy.

2. The waveguide mechanical phase adjuster of claim 1, wherein the spectral band is at or above 75 GHz.

3. The waveguide mechanical phase adjuster of claim 1, wherein said waveguide is a rectangular waveguide comprising opposing narrow walls and opposing wide walls, wherein said first pair of holes are in one of the narrow walls.

4. The waveguide mechanical phase adjuster of claim 1, wherein energy reflected off first and second dielectric rods in said first pair is approximately 180 degrees out of phase and substantially cancels.

5. The waveguide mechanical phase adjuster of claim 1, wherein said dielectric rods are formed of a dielectric material having a dielectric constant between approximately 2 to approximately 7.

6. The waveguide mechanical phase adjuster of claim 1, wherein said dielectric rods have a circular cross-section.

7. The waveguide mechanical phase adjuster of claim 1, wherein the dielectric rods are substantially identical.

8. The waveguide mechanical phase adjuster of claim 1, wherein the adjustment mechanism comprises a plate configured to hold the rods, an adjustment screw to push down on the plate and set the insertion depth of the first pair of rods and a spring to push up on the plate.

9. The waveguide mechanical phase adjuster of claim 1, further comprising:

a solid-state amplifier chip coupled to the waveguide downstream of the first pair of rods.

10. The waveguide mechanical phase adjuster of claim 1, further comprising:

a second pan of holes in the wall of the waveguide, said holes spaced approximately one-quarter of the center wavelength of the band apart, said holes dimensioned such that the holes are in cutoff at the highest frequency in the spectral band;

a second pair of dielectric rods inserted through said second pair of holes in the wall of the waveguide; and a second adjustment mechanism for varying an insertion depth of the second pair of dielectric rods into the waveguide to vary the dielectric loading of the waveguide and set the insertion phase of the propagating energy.

11. The waveguide mechanical phase adjuster of claim 10, wherein said first and second adjustment mechanisms are a common adjustment mechanism.

12. The waveguide mechanical phase adjuster of claim 11, wherein said first and second pairs of dielectric rods are substantially identical and spaced approximately an odd integer multiple N of one quarter of the wavelength apart.

13. The waveguide mechanical phase adjuster of claim 12, where N equals one.

14. A waveguide mechanical phase adjuster, comprising:

a hollow metal rectangular waveguide dimensioned for propagation of energy in a spectral band at or above 75 GHz, said waveguide having opposing narrow walls and opposing wide walls;

a first pair of holes in one of the narrow walls of the waveguide, said holes spaced approximately one-quarter of a center wavelength of the band apart, said holes dimensioned such that the holes are in cutoff at the highest frequency in the spectral band;

a first pair of substantially identical dielectric rods inserted through said first pair of holes in the wall of the waveguide; and a first adjustment mechanism fir varying an insertion depth of the first pair of dielectric rods into the waveguide to vary a dielectric loading of the waveguide and set an insertion phase of the propagating energy, wherein energy reflected off first and second dielectric rods in said first pair is approximately 180 degrees out of phase and substantially cancels.

15. The waveguide mechanical phase adjuster of claim 14, further comprising:

a second pair of holes in the narrow wall of the waveguide, said holes spaced approximately one-quarter of the center wavelength of the band apart, said holes dimensioned such that the holes are in cutoff at the highest frequency in the spectral band;

a second pair of substantially identical dielectric rods inserted through said second pair of holes in the wall of the waveguide; and a second adjustment mechanism for varying an insertion depth of the second pair of dielectric rods into the waveguide to vary the dielectric loading of the waveguide and set the insertion phase of the propagating energy.

16. A power combiner, comprising:

an RF input configured to receive energy in a spectral band a 1:N hollow metal waveguide splitter that separates the RF energy between N waveguide channels, where N is an integer greater than one;

N solid-state amplifier chips, each chip configured to amplifier the RF energy propagating in one of said waveguide channels;

at least N-1 mechanical phase adjusters positioned in different waveguide channels in front of the amplifier chips;

a N:1 power combiner that combines the amplified RF energy in the N waveguide channels into a single amplified RF signal;

wherein each said mechanical phase adjuster comprises, a first pair of holes in a wall of the waveguide, said holes spaced approximately one-quarter of a center wavelength of the band apart, said holes dimensioned such that the holes are in cutoff at the highest frequency in the spectral band;

a first pair of dielectric rods inserted through said first pair of holes in the wall of the waveguide; and an adjustment mechanism for varying an insertion depth of the first pair of dielectric rods into the waveguide to vary a dielectric loading of the waveguide and set an insertion phase.

17. A power combiner of claim 16, wherein the N:1 power combiner comprises:

a N:1 hollow metal waveguide combiner that combines the amplified RF energy in the N waveguide channels into a single waveguide channel; and an RF output configured to output the amplified RF signal.

18. A power combiner of claim 16, wherein the N:1 power combiner comprises:

N free-space radiating elements that spatially combine the amplified RF energy in the N waveguide channels into the amplified RF signal in free space.

19. A power combiner of claim 16, wherein energy reflected off first and second dielectric rods in said first pair is approximately 180 degrees out of phase and substantially cancels.

20. A power combiner of claim 16 that comprises N mechanical phase adjusters positioned in different waveguide channels.

* * * * *